US009896907B2

(12) United States Patent
Kucera

(10) Patent No.: US 9,896,907 B2
(45) Date of Patent: Feb. 20, 2018

(54) EQUALIZER VALVE WITH OPPOSED SEALS BIASED TOWARD CLOSED FROM RISING PRESSURE ON EITHER OF OPPOSED SIDES

(71) Applicant: BAKER HUGHES INCORPORATED, Houston, TX (US)

(72) Inventor: Samuel C. Kucera, Tulsa, OK (US)

(73) Assignee: Baker Hughes, a GE company, LLC, Houston, TX (US)

( * ) Notice: Subject to any disclaimer, the term of this patent is extended or adjusted under 35 U.S.C. 154(b) by 242 days.

(21) Appl. No.: 14/922,851

(22) Filed: Oct. 26, 2015

(65) Prior Publication Data

US 2017/0114610 A1 Apr. 27, 2017

(51) Int. Cl.
*E21B 34/10* (2006.01)
*E21B 34/14* (2006.01)

(52) U.S. Cl.
CPC ..... *E21B 34/101* (2013.01); *E21B 34/14* (2013.01)

(58) Field of Classification Search
CPC ..... E21B 34/101; E21B 34/14
See application file for complete search history.

(56) References Cited

U.S. PATENT DOCUMENTS 3,078,923 A * 2/1963 Tausch
3,273,649 A 9/1966 Tamplen
3,799,204 A * 3/1974 Watkins
3,854,502 A * 12/1974 Mott
3,941,035 A 3/1976 Mueller
4,103,744 A * 8/1978 Akkerman
4,276,937 A 7/1981 Calhoun et al.
4,289,165 A 9/1981 Fredd
4,361,075 A 11/1982 Block
4,415,036 A 11/1983 Carmody et al.
4,460,040 A 7/1984 Bowyer
4,478,286 A 10/1984 Fineberg
4,660,646 A 4/1987 Blizzard
4,722,399 A 2/1988 Pringle
4,844,114 A 7/1989 Moberg et al.
5,058,682 A * 10/1991 Pringle
5,318,127 A 6/1994 Hines et al.
5,346,178 A 9/1994 Baker
5,609,178 A 3/1997 Hennig et al.
5,890,698 A 4/1999 Domytrak
(Continued)

OTHER PUBLICATIONS

International Search Report and Written Opinion, dated Mar. 20, 2014; International Application No. PCT/US2013/074239; Korean Intellectual Property Office; 7 pages.
(Continued)

*Primary Examiner* — James G Sayre
(74) *Attorney, Agent, or Firm* — Steve Rosenblatt

(57) ABSTRACT

An equalizer valve is configured to stay shut when pressure on one side or the other goes up. A dynamic seal and a metal to metal seal are located within the housing. Pressure from above is directed uphole of the metal to metal seal and downhole of the larger dynamic seal for a net closing force. Pressure from downhole is directed between the metal to metal and dynamic seals for a net force uphole to keep the metal seal closed. Normal operation is from a control line moving a rod piston to move a valve member to open the metal to metal seal for flow through the valve body.

15 Claims, 2 Drawing Sheets

(56) References Cited

U.S. PATENT DOCUMENTS

| | | | |
|---|---|---|---|
| 6,296,061 | B1 | 10/2001 | Leismer |
| 9,033,054 | B2 | 5/2015 | Curington |
| 9,062,519 | B2 | 6/2015 | Kucera et al. |
| 2006/0266887 | A1 | 11/2006 | Holder et al. |
| 2009/0205836 | A1 | 8/2009 | Swietlik et al. |
| 2009/0278064 | A1 | 11/2009 | Grenaway et al. |
| 2011/0079393 | A1 | 4/2011 | Williamson |
| 2011/0079394 | A1 | 4/2011 | Plunkett et al. |
| 2011/0088906 | A1 | 4/2011 | Myerley |
| 2012/0012327 | A1 | 1/2012 | Plunkett et al. |
| 2013/0306166 | A1 | 11/2013 | Erb |
| 2014/0190704 | A1* | 7/2014 | Kucera |
| 2017/0226823 | A1* | 8/2017 | Ng |

OTHER PUBLICATIONS

Mason, et al., "Downhole High-Pressure Equalizing Safety Valves: A Solution Variable Labyrinth Seals," OTC 5576; Apr. 1987; 12 pages.

* cited by examiner

EQUALIZER VALVE WITH OPPOSED SEALS BIASED TOWARD CLOSED FROM RISING PRESSURE ON EITHER OF OPPOSED SIDES

FIELD OF THE INVENTION

The field of the invention is equalizer valves for subterranean tools such as barrier valves and more particularly equalizer valves insensitive to rising pressure on either side of the equalizer valve to stay in the closed position.

BACKGROUND OF THE INVENTION

Valves are ubiquitous in the downhole drilling and completions industry. As the purpose of valves is to selectively enable fluid communication through the valves, the formation of pressure differentials across valves is customary. Large differential pressures across a valve can not only affect the operation of the valve, but can result in damage to the valve due to the sudden inrush of fluid when the valve is opened. For example, ball valves are often used in the art as so-called barrier valves for at least temporarily shutting off production in a hydrocarbon well, which leads to very large pressure differentials. These large pressure differentials can result in the rotatable ball member of the valve to be pressed firmly against its housing, which causes large frictional forces between the ball and the housing and increased difficulty in opening the valve. The frictional forces and inrush of fluid to the valve when opened can cause damage to the valve such that it does not open, close and/or seal properly. Systems for equalizing pressure before opening barrier and similar valves have been developed, but the industry is always receptive of advances and alternatives in pressure equalization technology.

In view of the potential for large variations of pressure on either side of an equalizer valve when in the closed position, designs have been developed to maintain the valves in a closed position if the pressure on either side of a closed equalizer valve increases. One such design is described in U.S. Pat. No. 9,062,519. This design incorporates three seals two of which are dynamic seals 16 and 18 that define a chamber 46 that is pressurized with a control line 45. Pressure applied in control line 45 overcomes the force of the return spring 50 to move a piston 12 to separate metallic components 30 and 40 at the lower extremity 42 of the assembly. Without pressure applied in line 45 rising pressure at opposed ends of the equalizer valve 14 in regions designated as P1 and P2 will simply force the already closed valve 14 to stay in the closed position. This happens as pressure from P1 communicates to surface 36 which is larger than opposing surface 38 for a net closing force on piston 12. Higher pressure from P2 acts directly on surface 42 to push the piston in a direction that keeps surfaces 30 and 40 together for the closed position of valve 14.

While this design accomplishes the purpose of keeping the equalizer valve closed when it experiences a rise in end pressure at P1 or P2 it leaves the metal to metal seal of surfaces 30 and 40 exposed to velocity effects and associated erosion when the equalizer valve is actuated to open with pressure in line 45. Due to the annular piston design using surface 48 on piston 12 there need to be two opposed seals to define pressure chamber 46. As a result there are three seals required to accomplish the result of keeping the valve in a configuration where pressure increases on opposed ends do not open the valve.

The present invention addresses such issues by using two seals and a flow configuration that allows placement of a metal to metal seal internally to the housing with a tortuous path to reach the metal to metal seal to protect it from erosion when the equalizer valve is actuated to open with a rod piston that bears directly on the movable valve member. Springs can be provided to overcome seal friction in the rod piston actuator. The actuation system is depth insensitive. A plenum covers the lower seal and component configuration is such that pressure from below is conducted to between the dynamic and metal to metal seal while pressure from above is conducted to a back side of a dynamic seal and an uphole side of the metal to metal seal with a net result of a closure force. These and other aspects of the present invention will be more readily apparent to those skilled in the art from a review of the description of the preferred embodiment and associated drawings while recognizing that the full scope of the invention is to be determined from the appended claims.

SUMMARY OF THE INVENTION

An equalizer valve is configured to stay shut when pressure on one side or the other goes up. A dynamic seal and a metal to metal seal are located within the housing. Pressure from above is directed uphole of the metal to metal seal and downhole of the larger dynamic seal for a net closing force. Pressure from downhole is directed between the metal to metal and dynamic seals for a net force uphole to keep the metal seal closed. Normal operation is from a control line moving a rod piston to move a valve member to open the metal to metal seal for flow through the valve body.

DETAILED DESCRIPTION OF THE PREFERRED EMBODIMENT

Figure 1:
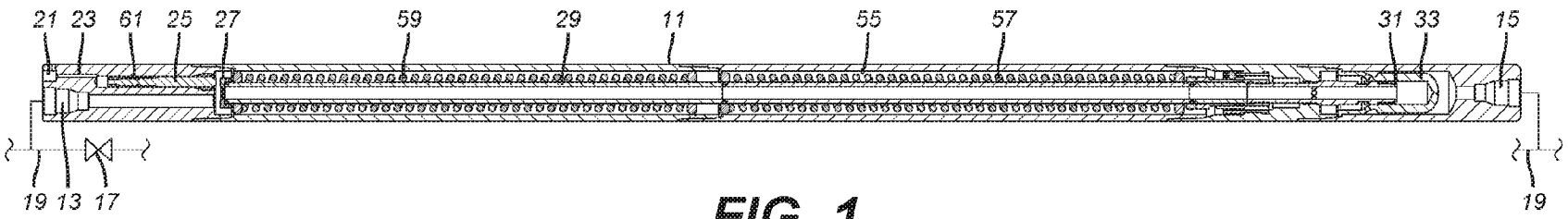
FIG. 1 is a section view of the equalizer valve in the closed position.
Figure 2:
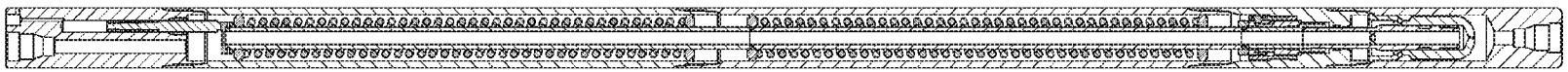
FIG. 2 is the view of FIG. 1 in the open position.
Figure 3:
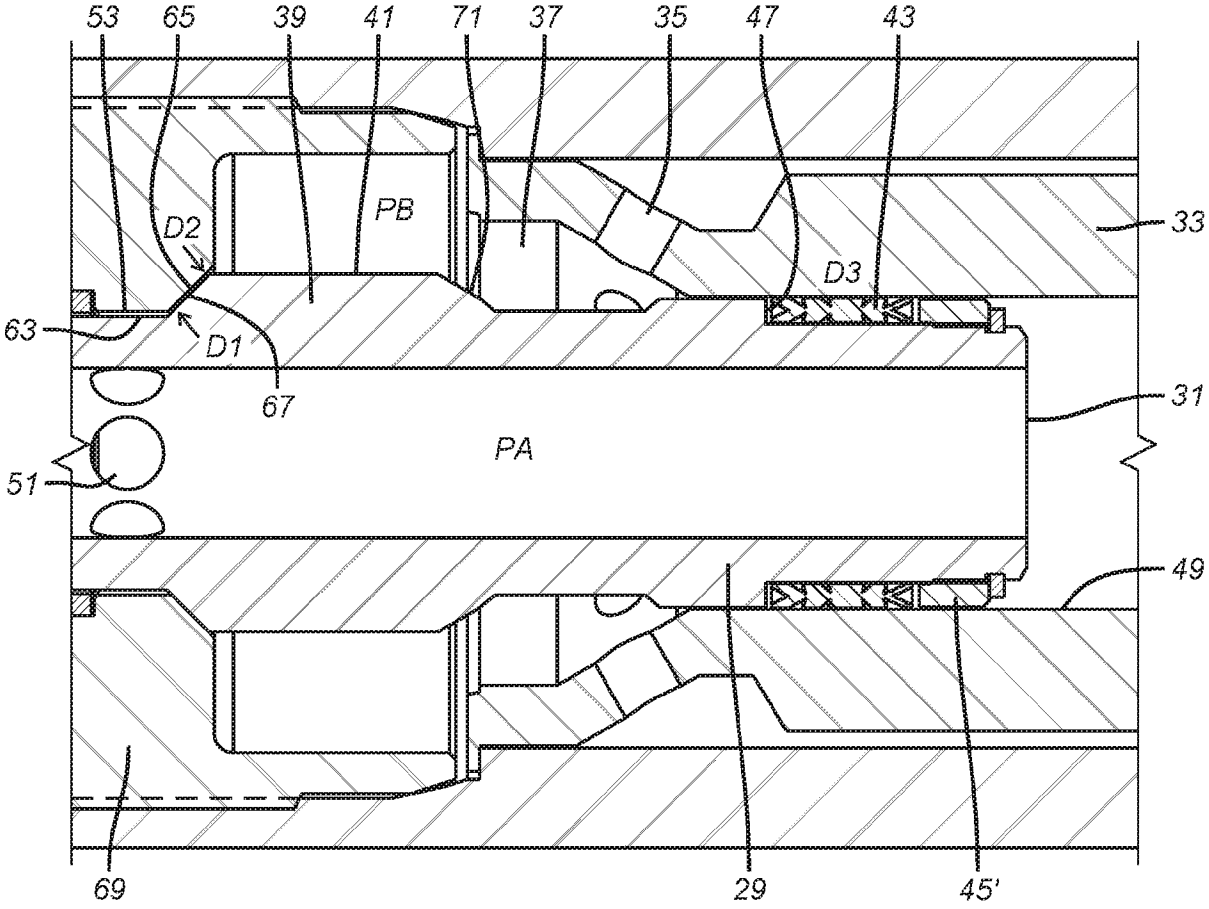
FIG. 3 is an enlarged view of a portion of FIG. 1.

Referring to FIG. 1 a body 11 has an uphole connection 13 and a downhole connection 15 connected to opposed sides of valve 17 that is mounted in a tubular string 19. Typically valve 17 is a barrier valve in a subterranean well but can be a number of other different tools. Connection 21 leads to a control line that is not shown that extends from a surface location. Pressure applied in control line 23 moves rod piston 25 against end cap 27 secured on top of tube 29. Tube 29 ends at lower end 31 and inside plenum 33. As better seen in FIG. 3 plenum 33 has ports 35 that lead to chamber 37. A circumferential projection 39 has an outer surface 41 that has a diameter D2. Dynamic seal 43 is retained by ring 45' against shoulder 47 on tube 29. Dynamic seal 43 is a dynamic seal with an outer diameter D3. Dynamic seal 43 seals against wall 49 in plenum 33. Tube 29 has ports 51 that communicate with annular space 53 which further extends into elongated annular space 55 that houses springs 57 and 59 each of which are mounted to provide an uphole force on cap 27 to push against rod piston 25 to overcome seal friction in rod piston seals 61 to return the piston 25 from the FIG. 2 to the FIG. 1 position when pressure is removed from control line 23. Space 53 has an outer dimension D1 defined by surface 63. Surfaces 65 on tube 29 and 67 on sub 69 form a metal to metal seal when forcibly abutted in FIG. 1 which shows the run in position with no flow through tube 29 because the lower end 31 is sealed by plenum 33 and dynamic seal 43 and surfaces 65 and 67 being forced together for the metal to metal seal. Surfaces 67 and 69 schematically represent any type of seal although metal to metal is preferred but as used in this application the term "metal to metal seal" is intended to capture its known alternatives including face nonmetallic seals or elastomer seals, for example. Thus pressure from uphole called PA reaches through tube 29 to a dead end at dynamic seal 43 which has a diameter D3 greater than diameter D1 at surface 63 that is accessed through ports 51. As a result raising pressure PA simply increases the net uphole force on tube 29 to hold surfaces 65 and 67 more firmly together. An increase in the pressure PB from downhole communicates through ports 35 to dynamic seal 43 to create a downhole oriented force against dynamic seal 43 as well as an uphole oriented force against surface 71. Since D2 represented by surface 41 is larger than D3 represented by diameter 49 a net uphole force is increased as pressure PB is increased keeping surfaces 65 and 67 together with increased force. In short, D2 being larger than D3 causes increases in pressure PB keep the surfaces 65 and 67 firmly together. The same result is obtained when pressure PA is increased because D3 is larger than D1 and PA accesses both dimensions through ports 51 and lower end 31 of tube 29.

To equalize valve 17 before trying to open it, control pressure is raised in control line 23 that shifts the piston 25 against springs 57 and 59 to separate surfaces 65 and 67 so that flow can go through ports 51, between separated surfaces 57 and 59 and through ports 35 and around the outside of plenum 33 and out lower end connection 15.

Those skilled in the art will appreciate that locating the metal to meal seal inside the housing and having a tortuous path leading to it from opposed directions minimizes the erosive effect of well fluids when the equalizer valve is opened. Additionally the components are configured to keep the valve closed on increasing pressure on either end of the equalizer valve. This is accomplished with just the spaced metal to metal seal and a dynamic seal. A rod piston allows the removal of a third seal in the body as configured in U.S. Pat. No. 9,062,519. The springs 57 and 59 are sized to overcome seal friction in a relatively small rod piston seal assembly as well as seal friction in dynamic seal 43.

The above description is illustrative of the preferred embodiment and many modifications may be made by those skilled in the art without departing from the invention whose scope is to be determined from the literal and equivalent scope of the claims below:

I claim:

1. A valve for subterranean use, comprising:

a housing comprising a valve member between an uphole and a downhole end;

two spaced seals within said housing to seal between said valve member and said housing, said seals defining a first zone located between said seals in said housing and a second zone straddling said seals and said first zone in said housing;

wherein pressure applied to said first and second zones from a respective said uphole or said downhole end maintains said valve member stationary in a closed position for said valve member;

said valve member selectively movable for pressure communication between said uphole and downhole ends.

2. The valve of claim 1, wherein:

said valve member is moved by a rod piston.

3. The valve of claim 1, wherein:

one of said spaced seals comprises a metal to metal seal.

4. The valve of claim 1, wherein:

one of said spaced seals comprises a dynamic seal.

5. The valve of claim 1, wherein:

said downhole end communicates with said first zone.

6. The valve of claim 1, wherein:

said uphole end communicates with said second zone.

7. The valve of claim 1, wherein:

said valve member comprising a passage therethrough for communication with said second zone through a passage lower end and ports through a wall defining said passage.

8. The valve of claim 1, further comprising:

a bias force from at least one spring located in said second zone.

9. The valve of claim 8, wherein:

said at least one spring is disposed around said valve member.

10. The valve of claim 9, wherein:

said at least one spring biases said valve member and said piston in tandem toward said uphole end.

11. The valve of claim 1, wherein:

opening said valve equalizes pressure on opposed sides of a closed isolation valve to facilitate opening the isolation valve.

12. A valve for subterranean use, comprising:

a housing comprising a valve member between an uphole and a downhole end;

two spaced seals within said housing to seal between said valve member and said housing, said seals defining a first zone located between said seals in said housing and a second zone straddling said seals and said first zone in said housing;

wherein pressure applied to said first and second zones from a respective said uphole or said downhole end maintains said valve member stationary in a closed position for said valve member;

said valve member selectively movable for pressure communication between said uphole and downhole ends;

said valve member comprising a passage therethrough for communication with said second zone through a passage lower end and ports through a wall defining said passage;

said passage lower end closed off by a plenum sealed to said valve member with one of said spaced seals that further comprises a dynamic seal, said plenum extending beyond said dynamic seal and further comprising a port communicating with said first zone.

13. The valve of claim 12, wherein:

the other of said spaced seals comprises a metal to metal seal.

14. The valve of claim 13, wherein:

said dynamic seal has a larger piston diameter in said second zone than an opposing diameter in said second zone adjacent said metal to metal seal, such that a net force from pressure in said second zone pushes opposed metal surfaces together in said metal to metal seal.

15. The valve of claim 14, wherein:

said first zone comprising a projection therein with a larger diameter than said dynamic seal such that a net force from pressure in said first zone pushes opposed metal surfaces together in said metal to metal seal.

* * * * *